United States Patent [19]

Gehin et al.

[11] Patent Number: 4,717,897

[45] Date of Patent: Jan. 5, 1988

[54] WIDE BAND POLARIZATION DIPLEXER DEVICE AND AN ANTENNA ASSOCIATED WITH A RADAR OR A COUNTER-MEASURE

[75] Inventors: Claude Gehin; Jacky Tourneur, both of Paris, France

[73] Assignee: Thomson CSF, Paris, France

[21] Appl. No.: 167,784

[22] Filed: Jul. 11, 1980

[30] Foreign Application Priority Data

Jul. 24, 1979 [FR] France ..... 79 19084

[51] Int. Cl.[4] ..... H01P 5/12; H01P 1/161

[52] U.S. Cl. ..... 333/125; 333/21 A; 333/34; 342/175

[58] Field of Search ..... 333/21 R, 21 A, 124, 333/125, 137

[56] References Cited

U.S. PATENT DOCUMENTS

| | | | |
|---|---|---|---|
| 2,923,895 | 2/1960 | Curtis et al. | 333/125 X |
| 2,942,261 | 6/1960 | Jones et al. | 333/21 R X |
| 2,954,558 | 9/1960 | Honey et al. | 333/21 R X |
| 4,176,330 | 11/1979 | Ditullio et al. | 333/21 A X |
| 4,222,017 | 9/1980 | Foldes | 333/21 A X |
| 4,490,696 | 12/1984 | Takeda et al. | 333/21 A X |

*Primary Examiner*—T. H. Tubbesing

*Attorney, Agent, or Firm*—Cushman, Darby & Cushman

[57] ABSTRACT

A very wide pass band polarization diplexer having a power divider, a transition element and a wave guide containing an impedance adapter, and applicable to all devices requiring the use of a wave guide in which two waves in orthogonal modes propagate.

8 Claims, 4 Drawing Figures

Figure 1:
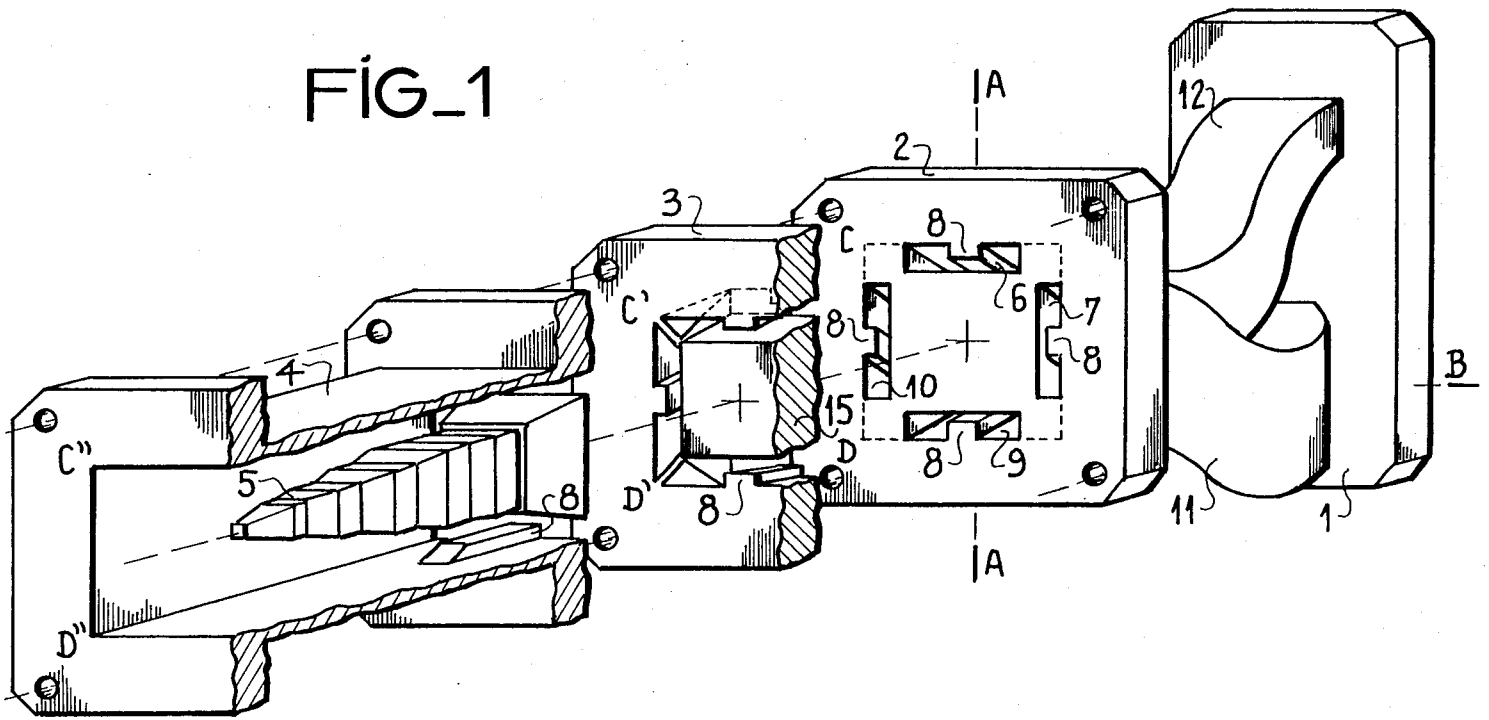

FIG_2-a
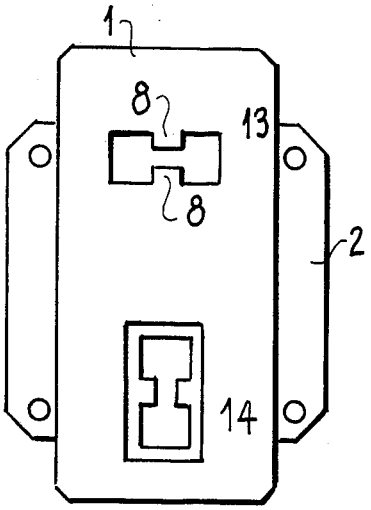
FIG_2-b
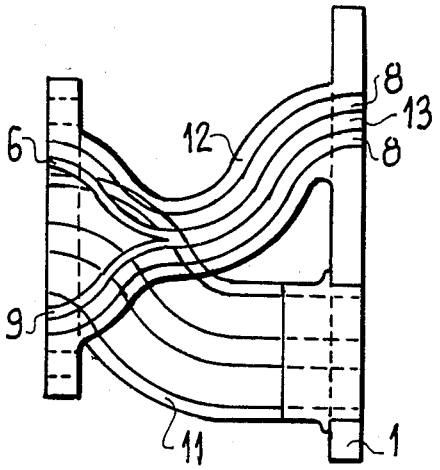
FIG_2-C
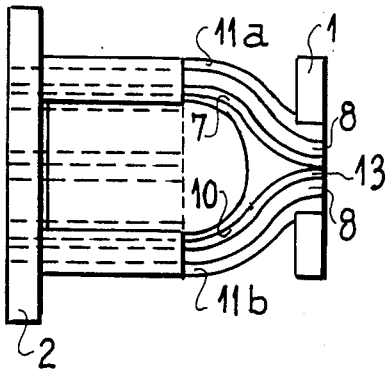

WIDE BAND POLARIZATION DIPLEXER DEVICE AND AN ANTENNA ASSOCIATED WITH A RADAR OR A COUNTER-MEASURE

The present invention covers a polarization diplexer device and a microwave equipment containing such a device.

A reciprocal microwave device with two inputs and one output such that, if two rectilinearly polarized electromagnetic waves at the same frequency are applied to the two inputs, two orthogonally polarized electromagnetic waves propagating in the same wave guide are obtained at the output is called a polarization diplexer.

Polarization diplexer devices are generally used in microwave devices in which two waves with orthogonal polarizations must propagate in the same wave guide. This is the case, for example, of the antenna feed for certain radars or countermeasure devices.

In certain types of radar it is necessary to provide an antenna feed device which ensures, from two microwave sources, the propagation in the same square-sectioned wave guide of two electromagnetic waves in two orthogonal modes, the $TE_{01}$ and $TE_{10}$ modes for example. Such a device has two inputs, which are independant and decoupled one from the other and enable a third suitably dimensioned channel to be individually energized in which the two modes considered can propagate.

In previous practice several solutions were used to make polarization diplexers.

The first solution consists in a rectangular section wave guide with four steps. It may be remembered that a step is formed by a metallic bar, usually of square or rectangular section, whose axis of symmetry is parallel to the axis of symmetry of the wave guide and which is mounted inside the wave guide on one of its walls in electrical contact with it. Energizing of the two orthogonal propagation modes is then obtained with two coaxial line-wave guide transitions. The first transition is fixed on one wall of the wave guide and the second on another, which is orthogonal to the first.

This device has the advantage of a wide pass band in use and the disadvantage of being limited to low powers.

Another solution consists in a first rectangular section wave guide in which an electromagnetic wave in the first mode propagates and which is coupled to a second rectangular section wave guide by one of its sides. A wave in a mode orthogonal to that of the one propagating in the first wave guide propagates in the second guide. This solution, which does not include coaxial lines, is satisfactory for power purposes but, because of the construction used, can only be used in a narrow pass band.

The device in accordance with the invention seeks to correct these disadvantages by having both a wide operating pass band, which may exceed an octave, and a high power capability.

In accordance with one characteristic of the invention, the polarization diplexer device has a power divider whose input has two rectangular section wave guides and the output four rectangular section wave guides, a square section wave guide with an impedance adapter and a transition element making it possible to pass from the four rectangular section wave guides to the square section wave guide, the cooperation of these three elements making possible a wide pass band and a high power capability.

Other advantages and characteristics of the invention will appear from the description which follow with the help of the figures that show:

in FIG. 1, an overall view of the device in accordance with the invention;

in FIGS. *2a, 2b* and *2c*, the details of the production of the power divider which is part of the device in accordance with the invention.

FIG. 1 shows a wide band polarization diplexer device in which the combination of the following three elements can be distinguished: a power divider with two inputs and four outputs, a transition element making possible the connection of the four outputs from the power divider and a square section wave guide with an impedance adapter. The combination of these three elements makes it possible to obtain the propagation of two electromagnetic waves in the orthogonal $TE_{10}$ and $TE_{01}$ modes in the square section output wave guide from two electromagnetic waves propagating in the $TE_{01}$ mode for example. The cooperation of these three elements ensures a high power capability because only wave guides are used, high insulation between the energizing channels and a relatively low V.S.W.R. which may reach 1.2 for example. These three elements are purely metallic and may be made from the same metal.

The power divider has two wave guides 11 and 12 with two steps 8 whose inputs are available on a plate 1 which allows connection to the two energizing sources. Each of these wave guides 11 and 12 is devided into two identical parts along a symmetry plane parallel to the big side of the straight section of the wave guide considered. Each half of the wave guide thus has a step. The output 2 of this power divider therefore contains the four outputs of wave guides 6, 7, 9 and 10 with one step 8, which are symmetrically arranged with respect to the centre of output plate 2 so that the four wave guides 6, 7, 9 and 10 are in a square formed by the straight lines corresponding to each of the sides of the wave guides which contains the step 8. In the continuation, CD, the side of this square tangent to the side of the output of wave guide 10 may be seen. As wave guides 6, 7, 9 and 10 come from the division of wave guides 11 and 12 with two steps 8, wave guides 6 and 9 come from the division of wave guide 12 and wave guides 7 and 10 from the division of wave guide 11.

The transition element 3, by a change of geometry, makes it possible to pass from the four rectangular section wave guides 6, 7, 9 and 10 and one step 8 to a single square section wave guide with four steps, the side C' D' of the square section being of the same length as the segment CD previously defined. The change of geometry consists simply in a progressive enlargement of the side containing step 8 of the four wave guides 6, 7, 9 and 10 so that at the output of transition element 3 the four wave guides 6, 7, 9 and 10 each have a trapezoidal section, the big base of the trapezium corresponding to the side of the guide containing the step. Also, at the output of transition element 3, each of the four sections of wave guides 6, 7, 9 and 10 is tangent on one side to its two nearest neighbors. The length of transition element 3 is not critical; however, a slow change in the geometry of wave guides 6, 7, 9 and 10 is desirable to obtain the best possible V.S.W.R. In practice, this length may be greater than $\lambda/2$ where $\lambda$ corresponds to the biggest wave length in the frequency band for which the polarization diplexer is designed. At the output of transition element 3 than there is available a square section wave guide with four steps with a square section center core 15 the length of whose side is equal to the large side of the straight section of one of guides 11 or 12.

The square section output wave guide 4 has four steps 8 in the continuation of and in electrical contact with those coming from output 2 of the power divider through transition element 3. These four steps are interrupted in square section wave guide 4.

In the center of square section wave guide 4 there is an impedance adapter 5 which continues the center core 15 of transition element 3. Impedance adapter 5 may be made in several ways. FIG. 1 shows a structure consisting of a pile of rectangular parallelepipeds with a decreasing square section of length $\lambda/4$ where $\lambda$ is the wave length previously defined, which are connected one to another by elements which allow a progressive change from one square section to another of smaller dimensions. The number, n, of rectangular parallelepipeds and hence the full length of impedance adapter 5 depends mainly on the width of the pass band required. On this subject, reference may be made to the article by Seymour and B. Cohn in IRE Transactions—Microwave Theory and Techniques for April 1955. It is also possible, by making n infinite, to obtain a curved profile corresponding to a decrease in accordance with a cartesian curve of the square section in impedance adapter 5.

In this case, the length of the impedance adapter 5, the variation of whose section is continuous, remains roughly of the same order of size as that obtained for an impedance adapter 5 formed by a succession of parallelepipedic, square section elements. The length of square section wave guide 4 is so chosen as to be greater than the length of impedance adapter 5.

FIG. 2*a* shows input 1 of the power divider seen from the front. Apart from the elements already described, it contains inputs 13 and 14 of wave guides 12 and 11 respectively.

FIG. 2*b* shows a section of the power divider along a line AA. FIG. 2*c* shows a section of the power divider along a line BB. All the elements indicated in these last two figures have already been described.

The polarization diplexer device as it has been described is used with advantage to feed antennas associated with radars or counter-measure devices which require a feed with a single wave guide transmitting two electromagnetic waves in orthogonal propagation modes as, for example, antennas of the disc type or wide band cornet type in counter-measure equipement. An additional transition to make it possible to change from a square section wave guide to a circular one is then required in the case of a disc antenna. It makes it possible to obtain a single circularly polarized wave as required to feed this type of antenna.

In another way of making the invention, it is also possible to use only rectangular section wave guides without steps. The device is similar, only steps 8 disappear from the various elements forming the polarization diplexer. This type of construction, however, has the disadvantage of a reduced pass band compared with the type with steps which is the preferred type.

A wide pass band polarization diplexer device and an antenna associated with a radar or a counter-measure device containing such a device has thus been described.

What is claimed is:

1. A polarization diplexer device fed by two rectangular section wave guides in which two electromagnetic waves rectilinearly polarized at the same frequency propagate, characterized by the fact that it contains a power divider whose input has two rectangular section wave guides and whose output has four rectangular section wave guides, a square section wave guide containing an impedance matching device and a transition element, which makes it possible to pass from the four rectangular section wave guides to the square section wave guide.

2. A polarization diplexer device as in claim 1, characterized by the fact that, on the one hand each one of the two rectangular section wave guides at the input of the power divider is provided with two ridges and each one of the four rectangular section wave guides at its output with one ridge, said four wave guides being so arranged that the continuation of the side of each of said four wave guides on which the ridge is fixed forms a square of side d inside which the four wave guides are provided and, on the other hand, the transition element making it possible to pass from the four rectangular section wave guides with one ridge to a square section wave guide of side d comprises a square section center core.

3. A polarization diplexer device as in claim 2, characterized by the fact that the transition element converts, progressively and continuously, the rectangular section of each of the four wave guides into a trapezoidal section by enlarging the side provided with the ridge so that, at the output of this transition element, each of the four trapezoidal sections thus obtained is in contact by one of its sides with its two immediate neighbours.

4. A polarization diplexer device as in claim 3, characterized by the fact that transition element has a length greater than or equal to $\lambda/2$, in which $\lambda$ is the wave length corresponding to the lowest frequency in the pass band for which the device is designed.

5. A polarization diplexer device as in claim 2, characterized by the fact that the square section wave guide has four ridges in the continuation of those coming from the power divider through the transition element and in electrical contact with them.

6. A polarization diplexer device as in claim 5, characterized by the fact that the four ridges in the square section wave guide are interrupted before the output of square section wave guide.

7. A polarization diplexer device as in claim 2, characterized by the fact that the impedance matching device is a continuation of the center core and consists of parallelepipeds with decreasing square sections each having a length of $\lambda/4$ connected one to another by elements making possible a progressive and continuous passage from one square section to another smaller square section.

8. A polarization diplexer device as in claim 2, characterized by the fact that the impedance matching device is a continuation of the center core of the transition element and has a square section which decreases progressively in accordance with a continuous curve.

* * * * *